United States Patent [19]

von der Eltz et al.

[11] 3,958,288

[45] May 25, 1976

[54] PROCESS FOR THE CONTINUOUS DYEING OF HIGH QUALITY POLYESTER FIBERS

[75] Inventors: Hans-Ulrich von der Eltz, Frankfurt am Main; Egbert Kloss, Kelkheim, Taunus; Hartwig Kohler, Frankfurt am Main, all of Germany

[73] Assignee: Hoechst Aktiengesellschaft, Frankfurt am Main, Germany

[22] Filed: Mar. 26, 1973

[21] Appl. No.: 344,966

[30] Foreign Application Priority Data

Mar. 29, 1972 Germany ..... 2215249

[52] U.S. Cl. ..... 8/149.1; 8/149.2; 8/149.3; 68/DIG. 5; 68/5 E; 68/158; 68/177

[51] Int. Cl.² ..... D06B 3/02; D06B 3/10; D06B 21/02

[58] Field of Search ..... 8/149.1, 149.2, 149.3, 8/DIG. 16, 176, 179, 151, 174; 68/DIG. 5, 5 D, 5 E

[56] References Cited

UNITED STATES PATENTS

| | | | |
|---|---|---|---|
| 2,447,993 | 8/1948 | Vieira | 8/149.1 X |
| 3,593,543 | 7/1971 | Bergman | 68/5 D |
| 3,663,161 | 5/1972 | Litzler et al. | 8/179 X |
| 3,667,898 | 6/1972 | Bergman et al. | 8/174 X |
| 3,730,678 | 5/1973 | Wedler et al. | 8/149.1 |
| 3,824,814 | 7/1974 | Fleissner | 68/DIG. 5 |

*Primary Examiner*—Robert W. Jenkins
*Assistant Examiner*—Philip R. Coe
*Attorney, Agent, or Firm*—Curtis, Morris & Safford

[57] ABSTRACT

Process for the continuous dyeing of high-quality polyester fibers, wherein on the textile material, which has been impregnated with a dyeing liquor, the dyestuff applied is fixed by means of a combined treatment with saturated vapor at high pressure and a wet treatment at high temperature.

7 Claims, 9 Drawing Figures

PROCESS FOR THE CONTINUOUS DYEING OF HIGH QUALITY POLYESTER FIBERS

Figure 1A:
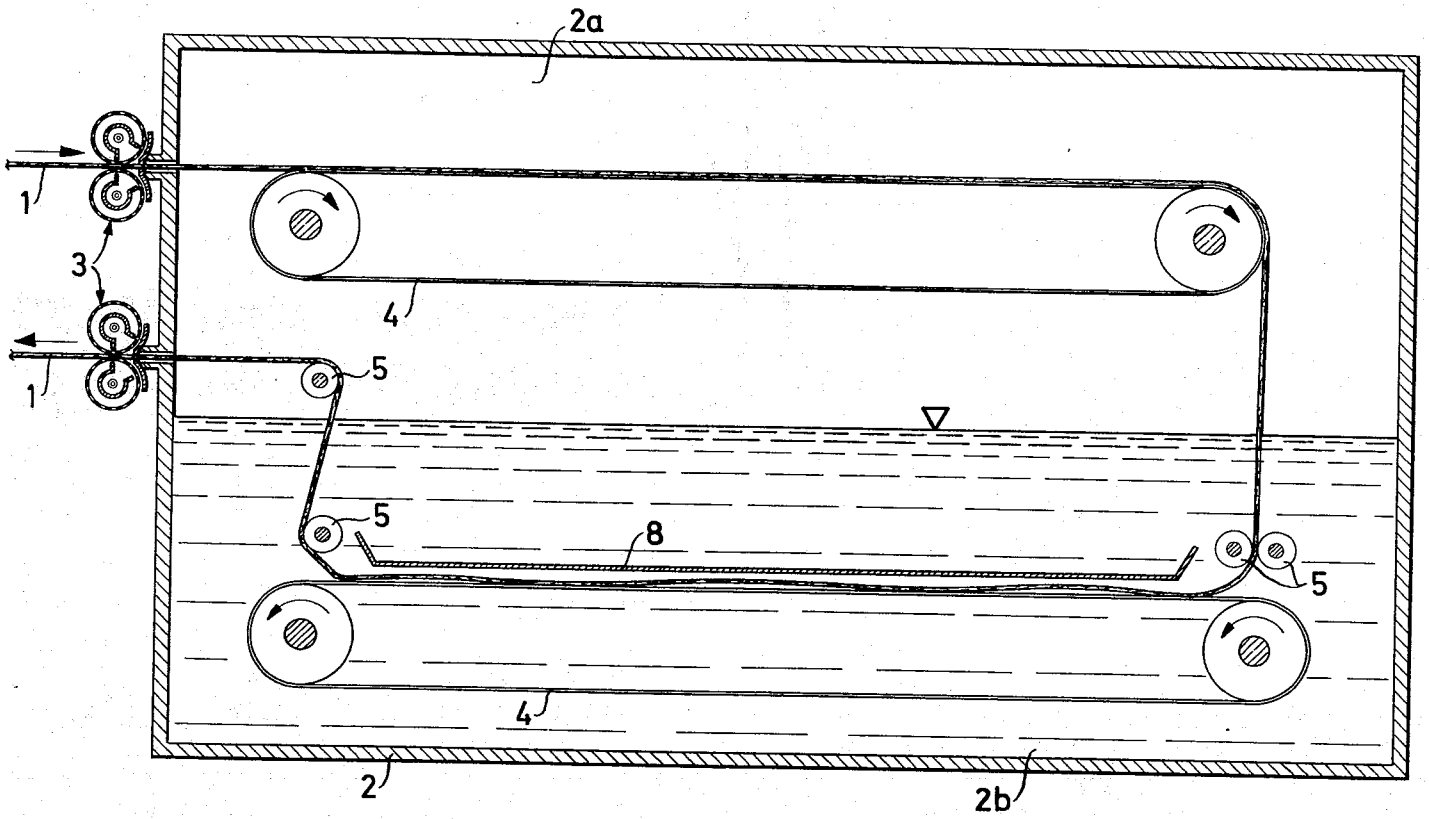

The present invention relates to a process for the continuous dyeing of high-quality polyester fibers.

Special care is required for the treatment of textile material made from texturized polyester fibers, especially of structured knit fabrics, in order to preserve their valuable properties, such as elasticity in each direction, soft feel and fulness of the goods. For a fiber that has been thermally texturized may lose texturization owing to thermal overstrain, the more so if, in addition to thermal overstrain, the fiber has to stand mechanical overstrain by being pulled or pressed too hard.

It is known that texturized polyester fibers can be dyed with Anthrasol dyestuffs(leuco esters of vat dyes-)under certain conditions according to a modified Thermosol process. In general, however, the Thermosol dyeing method does not play an important part in the production of medium and deep shades on texturized material webs, in spite of its simple and advantageous dyeing technique. With dyeings produced by the Thermosol process, it has not yet been possible to avoid or at least reduce the harsh feel, the less bulky, "meagre" goods and the unlevel dye penetration in the case of high-quality knit fabrics made from texturized polyester fibers.

To overcome those difficulties, attempts have been made to produce better dyeings according to the pad-pressure steaming process. Although the feel of the goods is improved in this case, an unlevel aspect and a certain "cracking" effect of the dyeing on the material prove that the padding and subsequent steam fixation under pressure neither yield optimum results. By the terms "cracking" or "cracked" fabrics in the case of elastic goods — mostly knit fabrics —, there are to be understood light spots which become visible in the interior of the knit goods upon stretching of the meshes (elongation in transverse direction).

It has now been found that even highly sensitive material, for example knit fabrics made from texturized polyester fibers, can be very well dyed by fixing the dyestuff on the material, which has been impregnated with a dyeing liquor, by means of a combined treatment with saturated vapor under high pressure and a wet treatment at high temperature. The whole dyeing process is thus a combination of padding and exhaust methods.

According to the process of the invention, the material is first dyed on a conventional padding machine. The padding liquor contains a dyestuff, a usual thickener and has a pH-value of 5.5 to 6. After padding, the material may be dried, for example contact-free in an infrared tunnel. The drying operation is, however, not compulsory nor crucial for a good dye penetration, a good dyestuff yield or levelness. The padded material is then entered, tension-free, via a roller lock into a continuous pressure-steamer or a special perforated drum steamer or perforated belt steamer, which is under an excess pressure of from 1 to 4, preferably from 2 to 3, atmospheres. The material is treated for 60 to 300, preferably for 90 to 180, seconds by passing it through a vapor atmosphere and then, under the same pressure and temperature conditions, through a wet-treatment compartment positioned in the same pressure tank. In this wet-treatment compartment which is filled only with water, the material is also conveyed tension-free. It leaves the unit after 90 to 180 seconds via a pressure-sealed roller lock and is cuttled up. It is then finished as usual. The above-indicated operational scheme may also be carried out the other way round by first subjecting the material to wet fixation under high temperature conditions and then to pressure steaming.

If, for example, full shades are to be obtained, it may be advantageous in special cases to strengthen the wet-fixation bath with a small amount of padding liquor, especially if high-temperature wet-fixation is performed prior to steaming. In exceptional cases, surface-active agents, compounds that increase viscosity and hydrostropic adjuvants may also be added to intensify the effect.

The device to be used according to the invention substantially comprises a unit intended for the continuous pressure-steaming and combined with a trough for the high-temperature wet-fixation. It is of no importance to the process whether the material is first passed through the wet-fixation trough under high temperature conditions and then fixed with the aid of pressurized vapor, or vice versa.

Pressure-steaming may also be performed alternatingly with the wet-fixation. The wet-fixation trough may be laid out in the form of one or more perforated drums placed, at least partly, beneath the surface of a liquid, or it may be some sort of a dwelling tank or even a simple chute. The high-temperature steamer may have the shape of a suction drum, a J-box, a chute or a pressure chamber equipped with deflecting rollers.

The only important requirement for the equipment of the unit is a tension-free transport of the material at any stage. The material may even be transported in loops through the unit.

The device of the invention is shown diagrammatically by way of example in the accompanying drawings.

FIGS. 1 to 7 are cross-sections of several embodiments of the device of the invention.

Figure 1B:
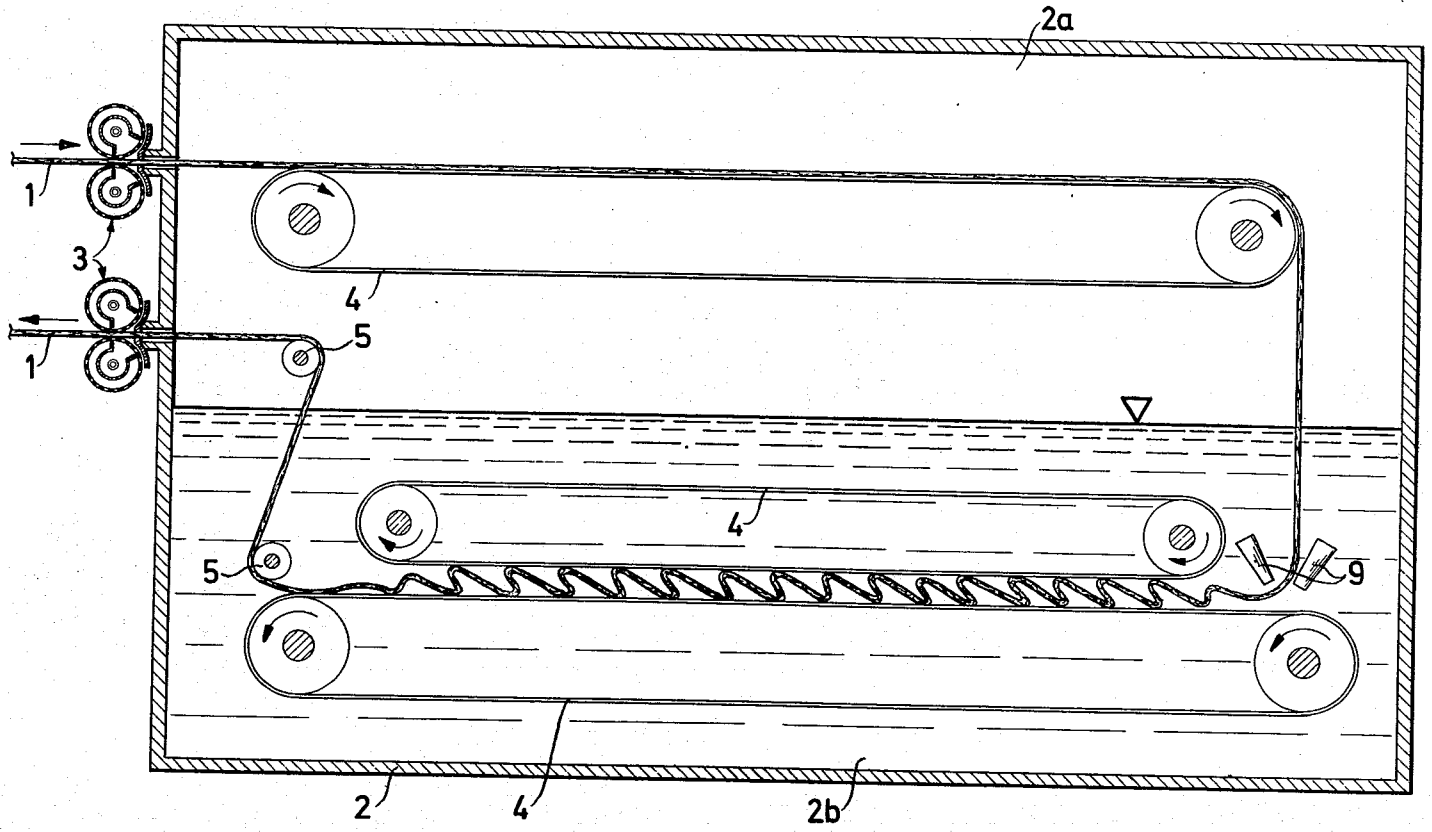

FIG. 1 *a* and *b* shows a unit, according to which the web of material 1 enters a joint pressure tank 2 via a pressure-sealing (roller lock) 3 and is transported, completely tension-free, by means of variably controlled endless conveyor belts 4 and deflecting rollers 5 first through a high-pressure steaming compartment 2*a* and then through a wet-treatment compartment 2*b*. The conveyor belts may also be perforated and placed under a relative suction-draught causing the treating medium to penetrate the material. The intensity of the wet treatment may even be increased by vigorously whirling about the liquor by means of winged wheels, rotors or jets operating against the transport direction of the material. Alternatingly operated cuttling-up nozzles 9 which can bee reversed, if a change in direction is intended, allow the material to be placed on the lower conveyor belt.

Figure 2A:
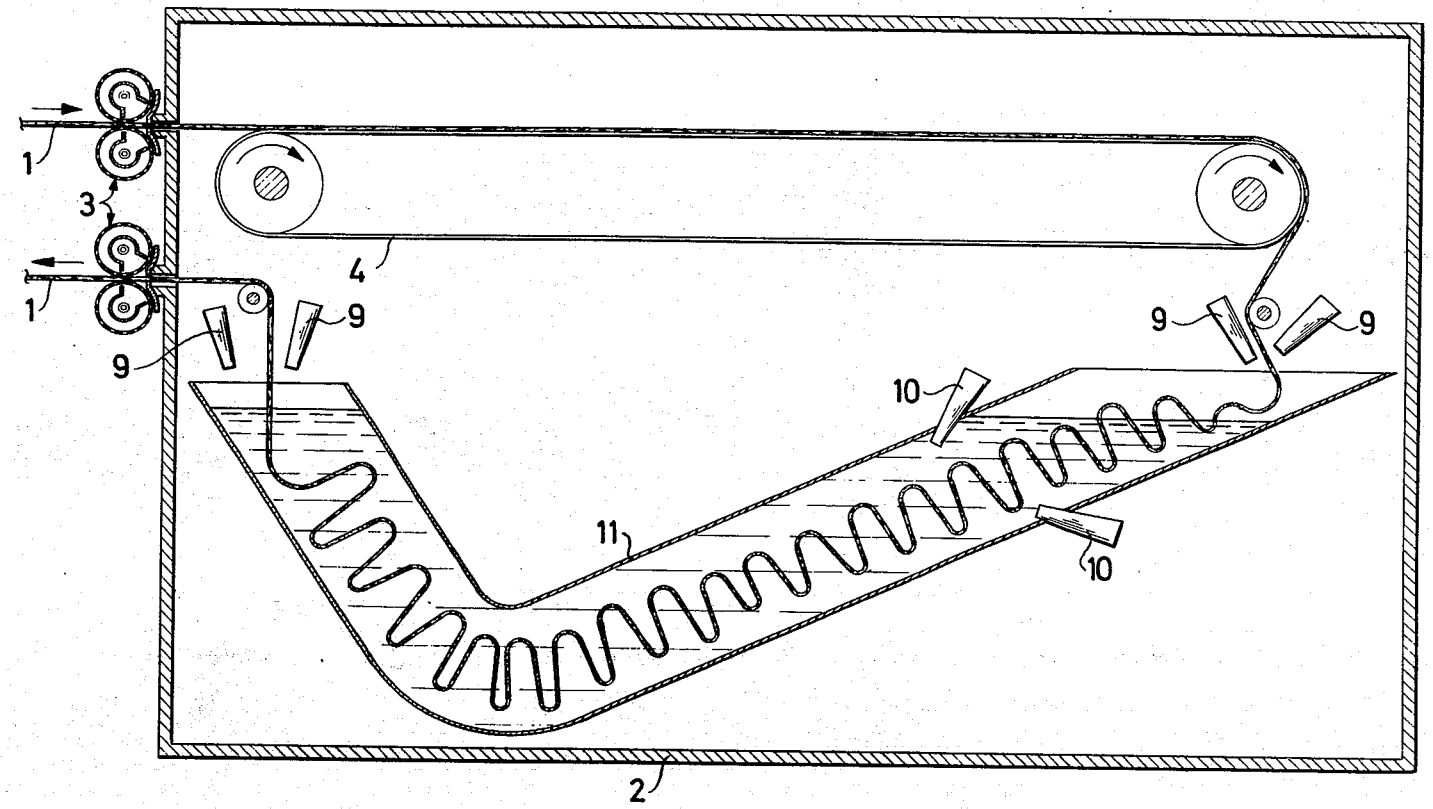
Figure 2B:
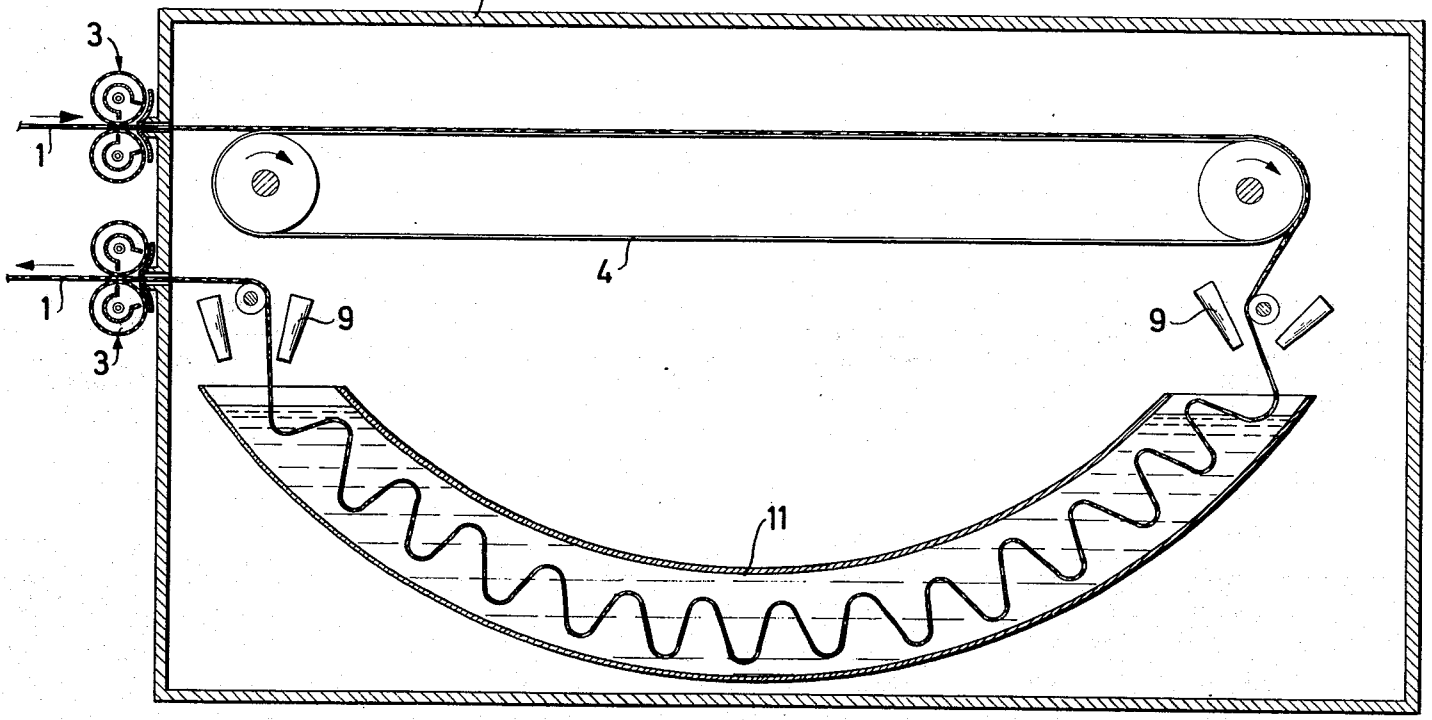

FIG. 2 *a* and *b* shows another embodiment, according to which the wet-treatment compartment is a bent material tank or dwelling tank 11. In the case of heavy material being dyed, the material may additionally be conveyed by means of transport nozzles 10.

Figure 3:
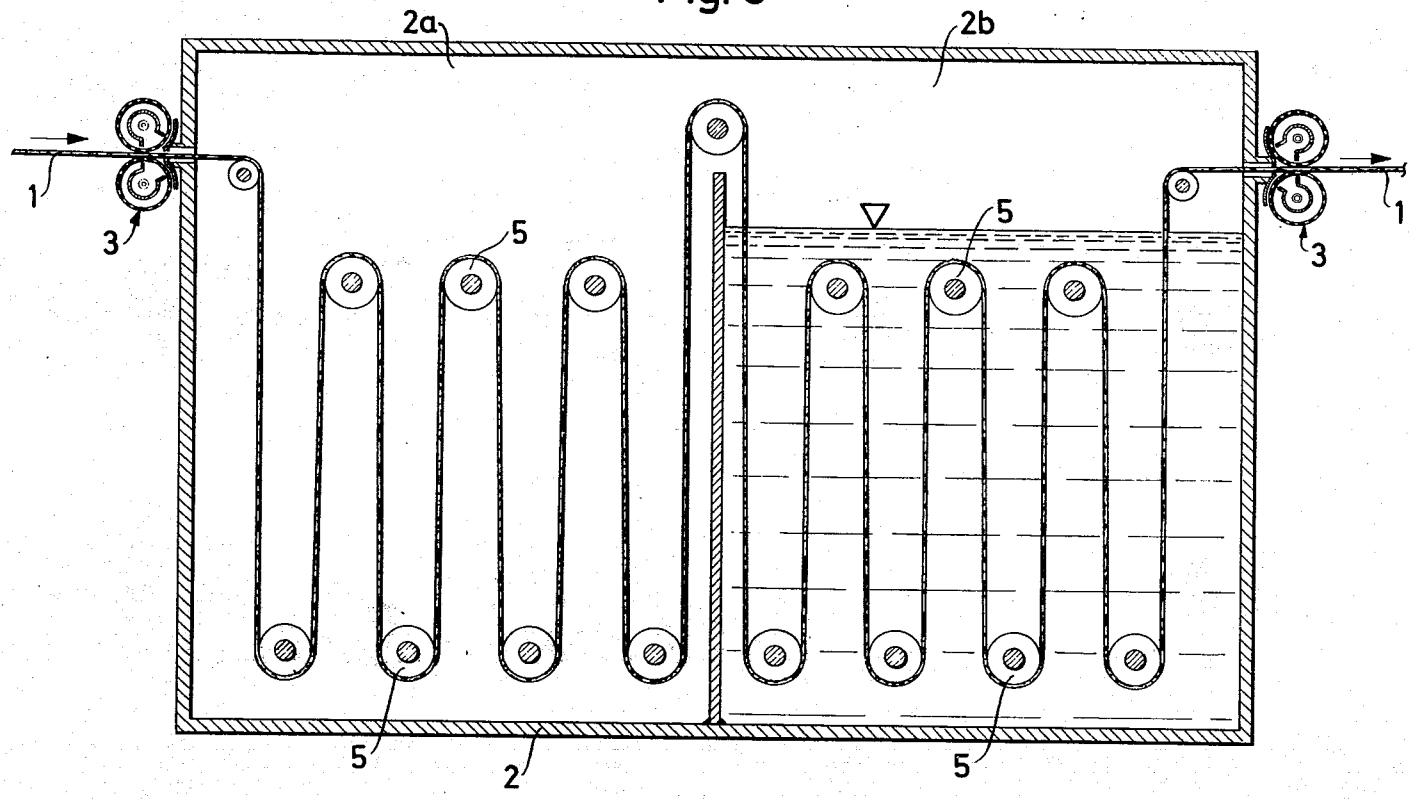

FIG. 3 shows a unit, in which the two compartments are arranged one beside the other. The material is conveyed by means of synchronous-operated guide and transport rollers 5 first through the high-pressure steaming compartment 2*a* and then through the wet-treatment compartment 2*b*.

Figure 4:
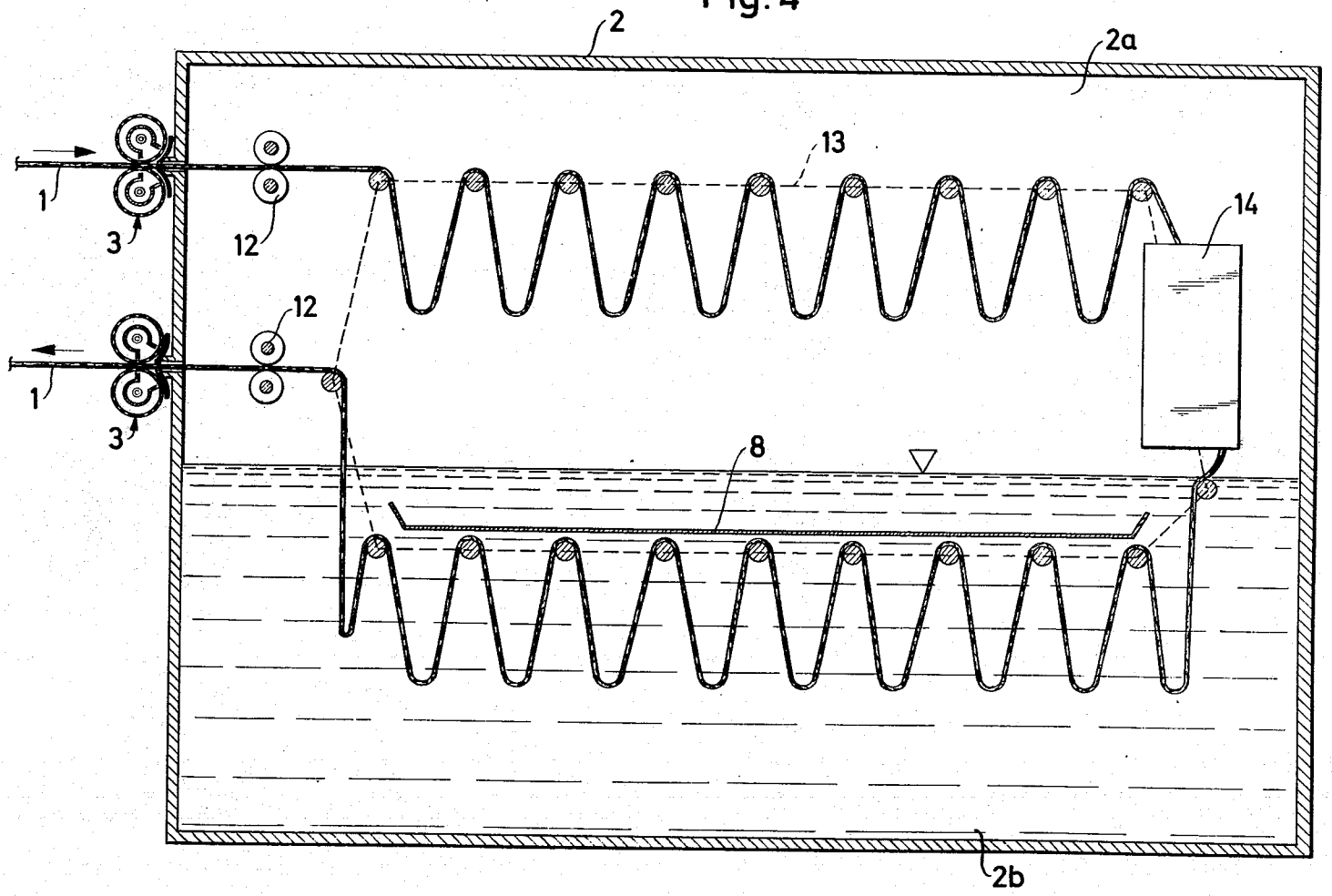

FIG. 4 shows a unit, in which one or more guiding plates 8 prevent the material from floating up. Pairs of rollers 12 serve to let the material on or off an endless transport chain 13 circulating via a deflecting element 14.

Figure 5:
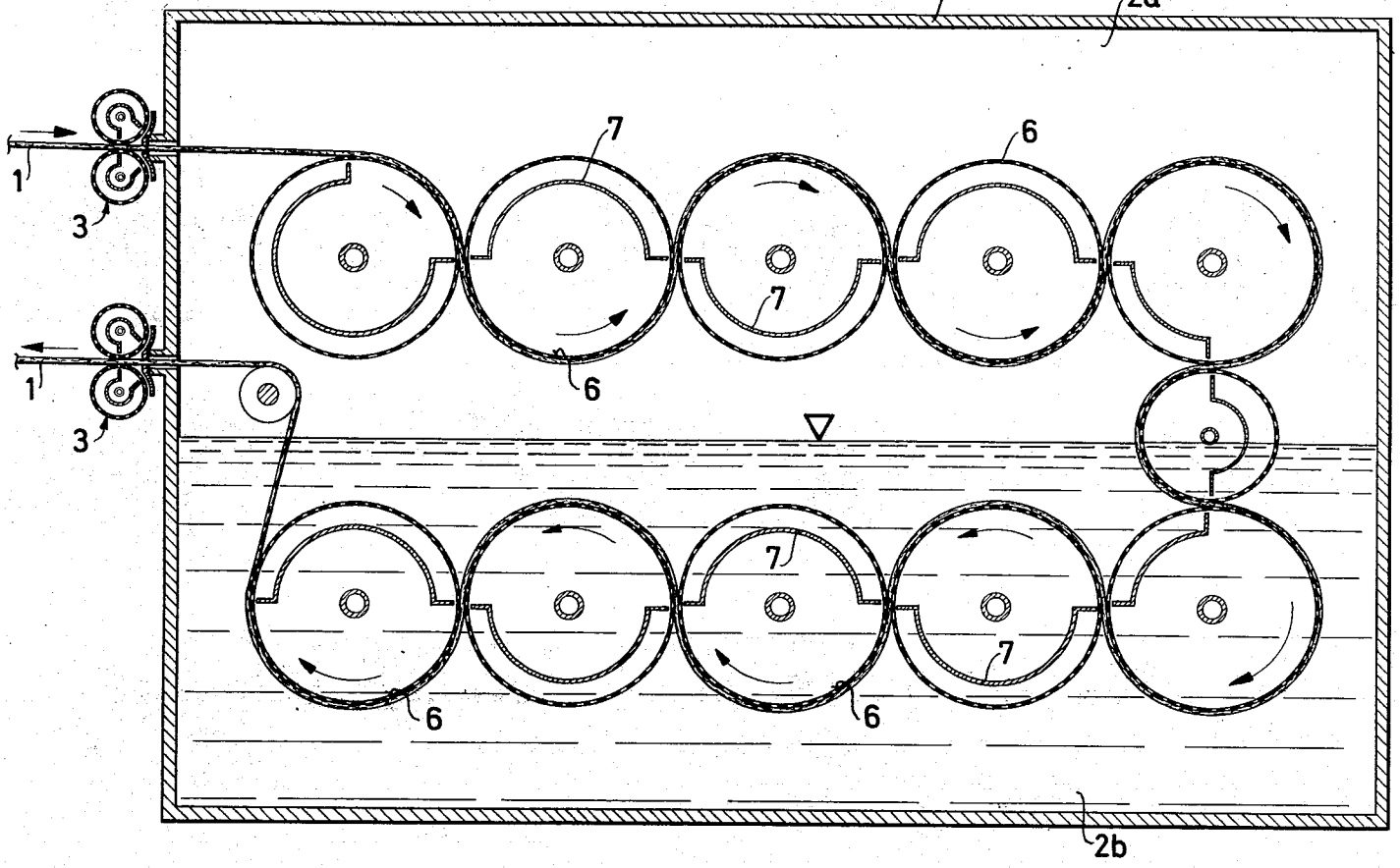
Figure 6:
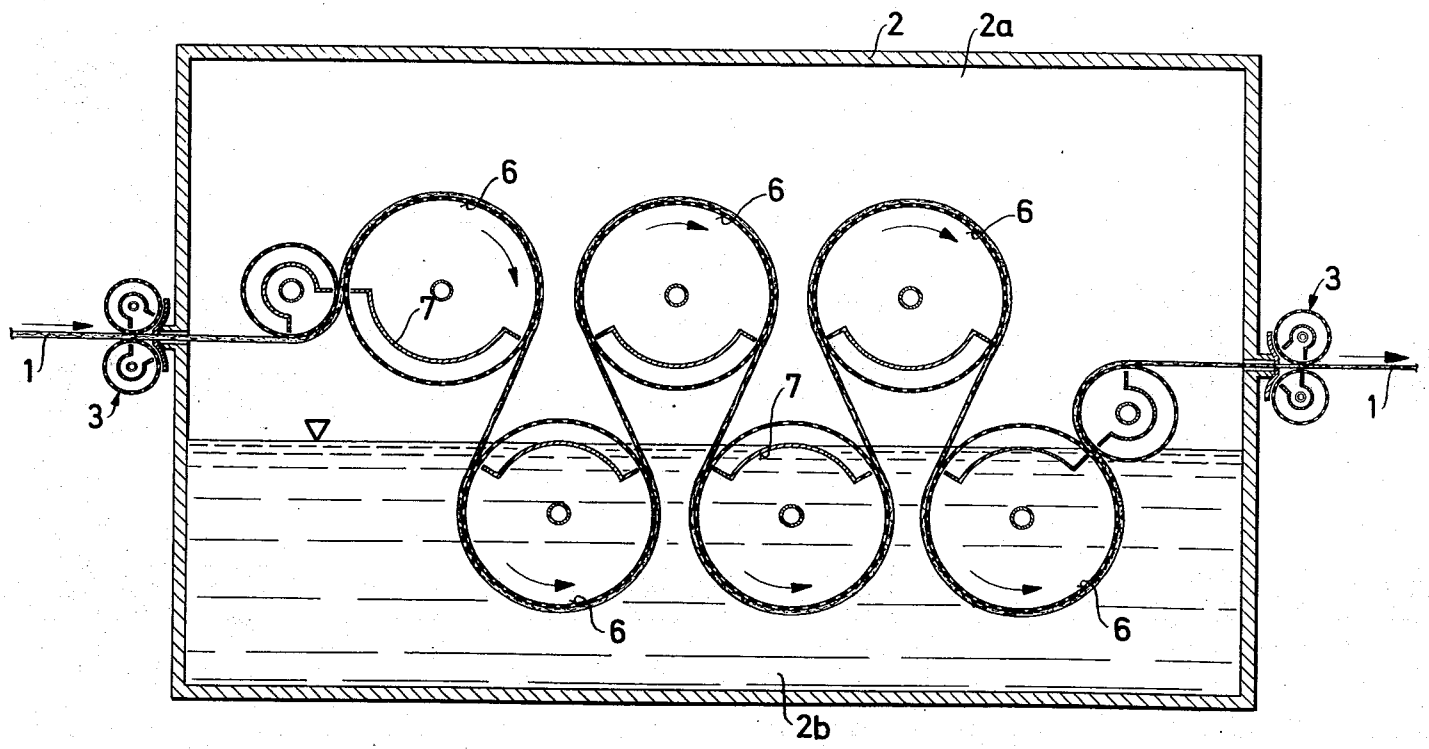
Figure 7:
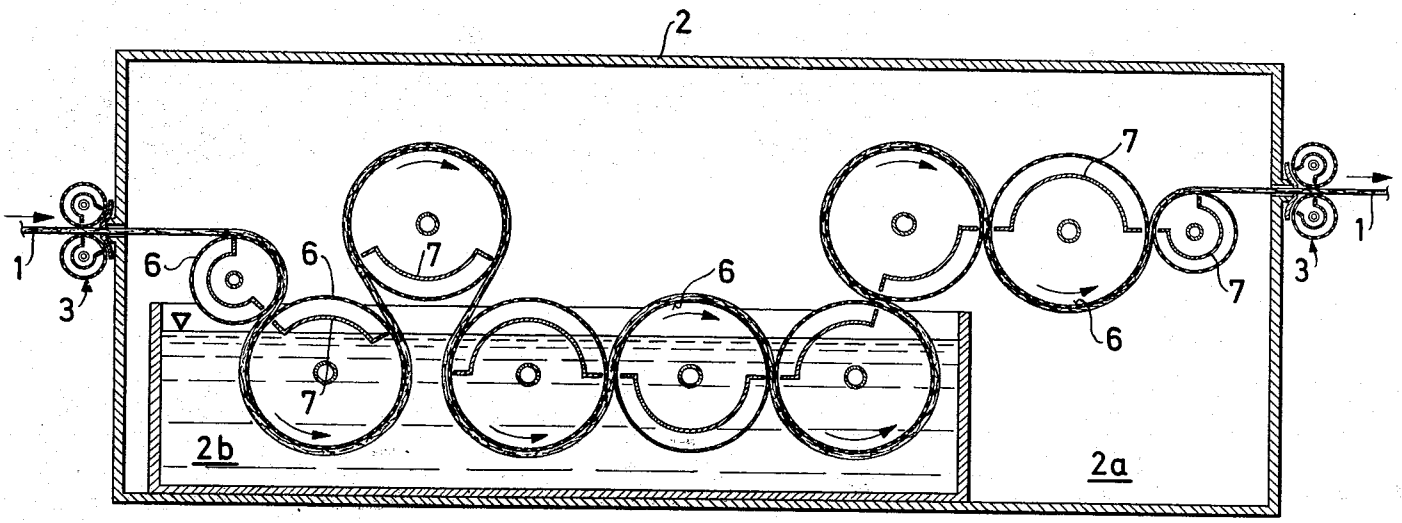

FIGS. 5 to 7 show other embodiments of the device, according to which the material is conveyed by means of rotating perforated drums 6. These drums, the interior of which is placed under suction-draught during operation, are in contact with one another over their full width and rotate about their axes, the rotation directions of the contacting drums being opposite with regard to each other in accordance with the transport direction of the material. Cover plates 7, which are fixedly installed in the interior of the drums and do not rotate with them, force the suction draught to take the material from one drum to the next one. Diameter, number and arrangement of the perforated drums may be adjusted to the individual conditions and technical facilities available. The width of the drums depends on that of the textile material to be treated and ranges from 500 to 3000 mm, generally from 900 to 2000 mm. The perforation of the drums to be in contact with the textile material advantageously has pores as fine as possible, and the distance between the pores should generally not be more than 30 mm, preferably less than 15 mm. It is sometimes advantageous to cover the outer surface of the perforated drums with one or more layers of a fine-meshed seamless wire fabric.

FIGS. 6 and 7 show units, in which high-pressure steaming alternates with the wet treatment.

All the units can be heated in usual manner, for example by means of direct or indirect steam.

In addition to the above-mentioned treatment of the material with steam/water or an aqueous liquor, the material may also be treated with solvent vapor/solvents under comparable thermal and pressure conditions. The above-disclosed pressure sealing (roller lock) is layed out so as also to allow dyeing from solvents. By the term "solvents" there are understood organic solvents, mixtures thereof with one another or with water, preferably as azeotropically boiling mixtures, in which the temperatures of the vapor and of the liquor are the same, as well as emulsions of solvents in water, or vice versa.

It is surprising that the disadvantages resulting from a fixation under pressure-steaming conditions, especially in the case of textile material made from texturized polyester fibers, can be avoided by combining that fixation method with a wet-fixation process under high temperature conditions. For example, according to the process of the invention, the dyestuff does not migrate, or if it does, this is compensated for by the high-temperature wet-fixation.

Hence, the material obtained has a satisfactory level dyeing from end to end, i.e. not tailing, and does not show any two-sidedness. Side-to-side shading does, in general, not occur since slight differences in shade are levelled out by the wet fixation. When the wet fixation is carried out prior to pressure steaming, different shading does not occur at all and the material has a better feel which does not become harsh. The knit fabric has a better shrinkage, is bulkier and is not flattened. Dye penetration of the material is satisfactory, the goods retain their original shape and elasticity, and texturization cannot be destroyed.

The fixation of the dyestuff according to the process of the invention is, moreover, brought about within a very short time, thus assuring high production rates to be obtained. The possibility of exchanging the two treatment stages against one another, moreover, allows the process to be adapted to various apparatus facilities available.

The following Examples serve to illustrate the invention, the parts and percentages being by weight unless stated otherwise.

EXAMPLE 1

Piece-goods made from texturized polyester fibers, having an elastic crepe structure, were padded, at room temperature and with a liquor pick-up of 70% in an aqueous liquor containing, per liter, 30 g of a golden-yellow disperse dyestuff of the formula

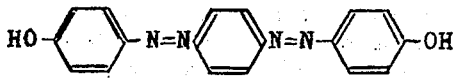

10 g of a non-ionic thickener on the basis of fully etherified (methylated) locust bean flour, 7 g of a non-ionic wetting agent (reaction product of 1 mol of isotridecanol with 5 mols of ethylene oxide) and 5 g of a non-ionic emulsifier (reaction product of 1 mol of castor oil with 36 mols of ethylene oxide).

The pH-value of the liquor was adjusted to 5 by means of acetic acid.

After padding, the goods were dried contact-free in an infrared tunnel and steamed continuously for 2 minutes under a pressure of 2.5 atmospheres gage. In the same pressure tank, the goods were then fixed tension-free by means of water without any further additives. The dwelling time was, in the aqueous phase, also 2 minutes and the temperature 138°C in accordance with the pressure conditions. After leaving the pressure tank via a roller lock (pressure-sealing), the goods were rinsed and finished in usual manner.

EXAMPLE 2

A stretch knit fabric made from texturized polyester fibers was padded via a broad-stretching device, at room temperature and with a liquor pick-up of 70%, with an aqueous liquor containing, per liter, 20 g of a red disperse dyestuff of the formula

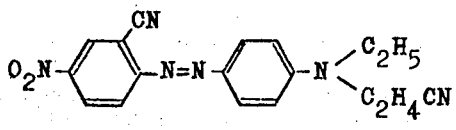

10 g of a non-ionic thickener on the basis of fully etherified (methylated) locust bean flour, 10 g of a predominantly anionic combination wetting agent containing sodium alkyl-sulfonate with 10% of a reaction product of 1 mol of isotridecanol with 8 mols of ethylene oxide, and 5 g of non-ionic emulsifier (reaction product of 1 mol of castor oil with 36 mols of ethylene oxide).

The pH of the liquor was adjusted to 5 by means of acetic acid.

After padding, the goods were introduced tension-free, without intermediate drying, into a pressure steamer via a roller lock and steamed for 2 minutes under a pressure of 2.5 atmospheres gage. Immediately after this; the goods were subjected tension-free to a wet treatment with water alone for 2 minutes at 138°C, rinsed and finished in usual manner.

A red dyeing was obtained having very good levelness and dye penetration even inside the stretch knit fabric.

EXAMPLE 3

A structured knit fabric made from texturized polyester fibers, having a Pique effect, was padded, at room temperature and with a liquor pick-up of 70%, in an aqueous liquor containing, per liter, 20 g of a red disperse dyestuff of the formula

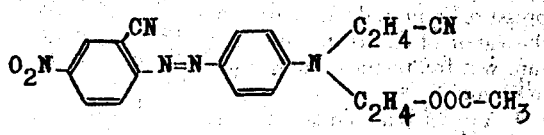

10 g of a non-ionic thickener on the basis of fully etherified (methylated) locust bean flour, 7 g of a non-ionic wetting agent (reaction product of 1 mol of isotridecanol with 5 mols of ethylene oxide) and 5 g of a non-ionic emulsifier (reaction product of 1 mol of castor oil with 36 mols of ethylene oxide).

The pH of the liquor was adjusted to 5 by means of acetic acid.

After padding, the goods were dried contact-free in a vertical infrared tunnel, introduced via a roller lock into a continuous high-temperature steamer and pressure-steamed for 2 minutes at 2.5 atmospheres gage. Immediately afterwards, the goods were passed tension-free and continuously through water contained in the same pressure tank. The reaction time was 2 minutes in accordance with the transport speed, and the temperature was about 138°C in accordance with the pressure conditions.

The goods left the pressure tank via a roller lock, were rinsed and finished up as usual.

A bright red dyeing having very good levelness and dye penetration was obtained.

EXAMPLE 4

Crepe material made from texturized polyester fibers was padded via a broad-stretching device, at room temperature and with a liquor pick-up of 70%, with an aqueous liquor containing, per liter, 15 g of a blue disperse dyestuff of the formula

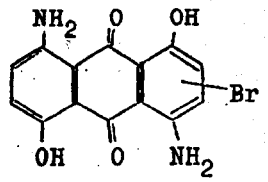

8 g of a yellow disperse dyestuff of the formula

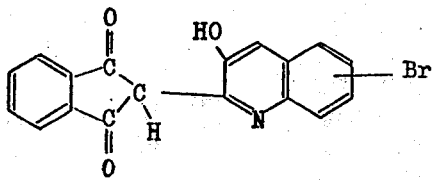

1 g of a red disperse dyestuff of the formula

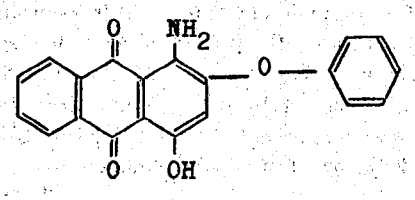

10 g of a non-ionic thickener on the basis of fully etherified (methylated) locust bean flour, and 10 g of a predominantly anionic combination wetting agent, preferably containing the sodium salt of alkylsulfonic acid, with 10% of a reaction product of 1 mol of isotridecanol with 8 mols of ethylene oxide.

The pH of the liquor was adjusted to 5 by means of acetic acid.

After padding, the goods were passed tension-free, without intermediate drying, via a roller lock into a pressure tank and treated with water for 2 minutes at about 138°C. In the same tank, the goods were then steamed with saturated steam for 2 minutes under a pressure of 2.5 atmospheres gage. After leaving the pressure tank via a pressure-sealing, the goods were rinsed and finished in usual manner.

A full dyeing having very good levelness and dye penetration was obtained.

EXAMPLE 5

A pre-wetted elastic knit fabric, having a Pique structure and being made from texturized polyester fibers, was padded, in moist or partly dried state, at room temperature and with a liquor pick-up of 70%, with an aqueous liquor containing, per liter.

10 g of a blue disperse dyestuff of the formula

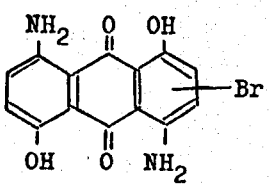

10 g of a yellow disperse dyestuff of the formula

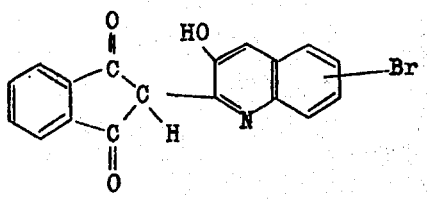

10 g of red disperse dyestuff of the formula

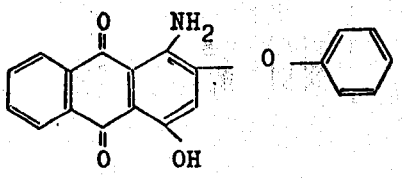

10 g of a non-ionic thickener on the basis of fully etherified (methylated) locust bean flour, and 5 g of a non-ionic emulsifier (reaction product of 1 mol of castor oil with 36 mols of ethylene oxide).

The pH of the liquor was adjusted to 5 by means of acetic acid. The goods were treated as in Example 4.

An anthracite-colored dyeing having very good levelness and dye penetration was obtained.

We claim:

1. A process for the continuous fixation of heat-fixable dyestuffs on flat surfaces of texturized polyester fibers, wherein the textile material impregnated with the dyestuff is subjected, in a pressure-tight closed system and tension-free, to a combined treatment with a saturated vapor at an excess pressure of from 1 to 4 atmospheres and a wet treatment, the temperature of the treating liquor corresponding to the pressure of the saturated vapor.

2. A process as claimed in claim 1, wherein the high-temperature wet treatment is carried out prior to the treatment with saturated vapor under high pressure.

3. A process as claimed in claim 1, wherein the high-temperature wet treatment is carried out after the treatment with saturated vapor under high pressure.

4. A process as claimed in claim 1, wherein the padded material is intermediately dried or partly dehydrated prior to the combined fixation method.

5. A process as claimed in claim 1, wherein the high-pressure saturated-vapor treatment is carried out with steam and the high-temperature wet treatment is carried out with water or an aqueous liquor.

6. A process as claimed in claim 1, wherein the high-pressure saturated-vapor treatment is carried out with the vapor of an organic solvent and the high-temperature wet treatment is carried out with the corresponding liquid

7. A process as claimed in claim 1, wherein, as textile material, knitted fabric is used.

* * * * *